US011165156B2

(12) United States Patent
Kim et al.

(10) Patent No.: US 11,165,156 B2
(45) Date of Patent: Nov. 2, 2021

(54) CHIP ANTENNA AND MANUFACTURING METHOD THEREOF

(71) Applicant: Samsung Electro-Mechanics Co., Ltd., Suwon-si (KR)

(72) Inventors: Jae Yeong Kim, Suwon-si (KR); Sung Yong An, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/829,603

(22) Filed: Mar. 25, 2020

(65) Prior Publication Data

US 2020/0243976 A1 Jul. 30, 2020

Related U.S. Application Data

(63) Continuation of application No. 15/993,225, filed on May 30, 2018, now Pat. No. 10,644,403.

(30) Foreign Application Priority Data

Aug. 29, 2017 (KR) ..... 10-2017-0109452
Nov. 23, 2017 (KR) ..... 10-2017-0157454

(51) Int. Cl.
*H01Q 9/04* (2006.01)
*H01Q 1/48* (2006.01)
(Continued)

(52) U.S. Cl.
CPC ..... *H01Q 9/0407* (2013.01); *H01Q 1/241* (2013.01); *H01Q 1/38* (2013.01); *H01Q 1/48* (2013.01)

(58) Field of Classification Search
CPC ..... H01Q 9/0407; H01Q 1/38; H01Q 1/48; H01Q 1/241
See application file for complete search history.

(56) References Cited

U.S. PATENT DOCUMENTS 5,854,606 A 12/1998 Kawahata et al.
2006/0244605 A1* 11/2006 Sakama ..... H01Q 23/00 340/572.7
(Continued)

FOREIGN PATENT DOCUMENTS

AU 2005248925 A1 11/2006
CN 1855626 A 11/2006
(Continued)

OTHER PUBLICATIONS

Chinese Office Action dated Jun. 3, 2020 in the related Chinese Patent Application No. 201810895122.X (13 pages in English and 8 pages in Chinese).
(Continued)

*Primary Examiner* — Hoang V Nguyen
(74) *Attorney, Agent, or Firm* — NSIP Law

(57) ABSTRACT

A chip antenna includes: a hexahedral-shaped body portion having a permittivity, and including a first surface and a second surface opposite to the first surface; a hexahedral-shaped radiation portion coupled to the first surface of the body portion; and a hexahedral-shaped ground portion coupled to the second surface of the body portion, wherein a width of each of the radiation portion and the ground portion is in a range of 100 μm to 500 μm.

18 Claims, 8 Drawing Sheets

(51) Int. Cl.
*H01Q 1/24* (2006.01)
*H01Q 1/38* (2006.01)

(56) References Cited

U.S. PATENT DOCUMENTS

| | | | | |
|---|---|---|---|---|
| 2009/0040120 | A1 | 2/2009 | Tsubaki et al. | |
| 2010/0225542 | A1 | 9/2010 | Suzuki et al. | |
| 2011/0001672 | A1 | 1/2011 | Harihara | |
| 2011/0050532 | A1 | 3/2011 | Liu | |
| 2011/0163921 | A1* | 7/2011 | Chirila | H01Q 1/526 343/702 |
| 2013/0120198 | A1 | 5/2013 | Maeda et al. | |
| 2017/0033468 | A1 | 2/2017 | Wong | |

FOREIGN PATENT DOCUMENTS

| | | | |
|---|---|---|---|
| CN | 101826655 | A | 9/2010 |
| CN | 101904050 | A | 12/2010 |
| CN | 102005640 | A | 4/2011 |
| CN | 204809394 | U | 11/2015 |
| JP | 11-136025 | A | 5/1999 |
| JP | 2000-357909 | A | 12/2000 |
| KR | 10-0930618 | B1 | 12/2009 |
| KR | 10-2013-0040813 | A | 4/2013 |
| WO | WO 2008/035526 | A1 | 3/2008 |
| WO | WO 2011/117621 | A2 | 9/2011 |

OTHER PUBLICATIONS

Chinese Office Action dated Jan. 6, 2020 in the related Chinese Patent Application No. 201810895122.X (15 pages in English, 8 pages in Chinese).

* cited by examiner

II-II'

CHIP ANTENNA AND MANUFACTURING METHOD THEREOF

CROSS-REFERENCE TO RELATED APPLICATIONS

This application is a continuation of U.S. application Ser. No. 15/993,225 filed on May 30, 2018, which claims the benefit under 35 U.S.C. § 119(a) of Korean Patent Application Nos. 10-2017-0109452 and 10-2017-0157454, filed on Aug. 29, 2017 and Nov. 23, 2017, respectively, in the Korean Intellectual Property Office, the entire disclosures of which are incorporated herein by reference for all purposes.

BACKGROUND

1. Field

The following description relates to a chip antenna and a manufacturing method of a chip antenna.

2. Description of Related Art

Mobile communications terminals such as cellular phones, personal digital assistants (PDAs), navigation systems, and notebook computers that support wireless communications are developing in line with a trend in which functions such as code-division multiple access (CDMA), wireless local area network (LAN), digital multimedia broadcasting (DMB), and near field communications (NFC) are added. An antenna is one of the most important components enabling these functions.

A chip antenna is a type of antenna directly mounted on a surface of a circuit board to perform a function of an antenna. Since a wavelength is decreased to several mm in a GHz band, it may be difficult to use a conventional chip antenna. Accordingly, a chip antenna suitable for use in the GHz band is desirable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna includes: a hexahedral-shaped body portion having a permittivity, and including a first surface and a second surface opposite to the first surface; a hexahedral-shaped radiation portion coupled to the first surface of the body portion; and a hexahedral-shaped ground portion coupled to the second surface of the body portion, wherein a width of each of the radiation portion and the ground portion is in a range of 100 μm to 500 μm.

The body portion may include a dielectric having a permittivity of 3.5 or to 25.

The radiation portion and the ground portion may each include a first conductor bonded to the body portion and a second conductor disposed on a surface of the first conductor.

The chip antenna may further include a bonding portion disposed between the first conductor and the body portion, and bonding the first conductor and the body portion to each other.

A height of each of the radiation portion and the ground portion may be greater than a height of the body portion.

A thickness of each of the radiation portion and the ground portion may be greater than a thickness of the body portion.

The width of the radiation portion and the width of the ground portion may be the same.

The width of the radiation portion may be greater than the width of the ground portion.

A thickness of the radiation portion may be different from a thickness of the ground portion, or a height of the radiation portion may be different from a height of the ground portion.

The chip antenna may be hexahedral-shaped and may include a longest side having a length of 2 mm or less.

The chip antenna may be configured to operate in a frequency band of 3 GHz to 30 GHz.

The radiation portion may include a protruding portion protruding onto a third surface of the body portion and extending toward the ground portion.

In another general aspect, a method to manufacture a chip antenna includes: disposing conductor layers on two surfaces of a dielectric member by printing or plating; cutting the dielectric member, with the conductor layers disposed thereon, into chip antennas; and disposing a second conductor on surfaces of each of the conductor layers.

The forming of the conductor layers may include forming the conductor layers on the two surfaces of the dielectric member such that the conductor layers comprise a thickness of 100 μm to 500 μm.

The second conductor may be formed of either one of Ni/Sn and Zn/Sn by plating.

The manufacturing method may further include, before the forming of the conductor layers, forming bonding layers on the two surfaces of the dielectric member.

The bonding layers may be formed by any one of printing, sputtering, spraying, and deposition, and each of the bonding layers may have a thickness of 10 μm to 50 μm.

In another general aspect, a chip antenna includes: a hexahedral-shaped dielectric portion including a first surface and a second surface spaced from the first surface in a width direction of the chip antenna; a radiation portion attached to the first surface; and a ground portion attached to the second surface, wherein a length, in the width direction, of each of the radiation portion and the ground portion is in a range of 100 μm to 500 μm, and wherein a length, in the width direction, of a longest side of the chip antenna is 2 mm or less.

The dielectric portion has a permittivity of 3.5 or to 25.

The chip antenna may further include bonding portions disposed between the radiation portion and the first surface, and between the ground portion and the second surface.

The bonding portions may each have a length, in the width direction, in a range of 10 μm to 50 μm.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
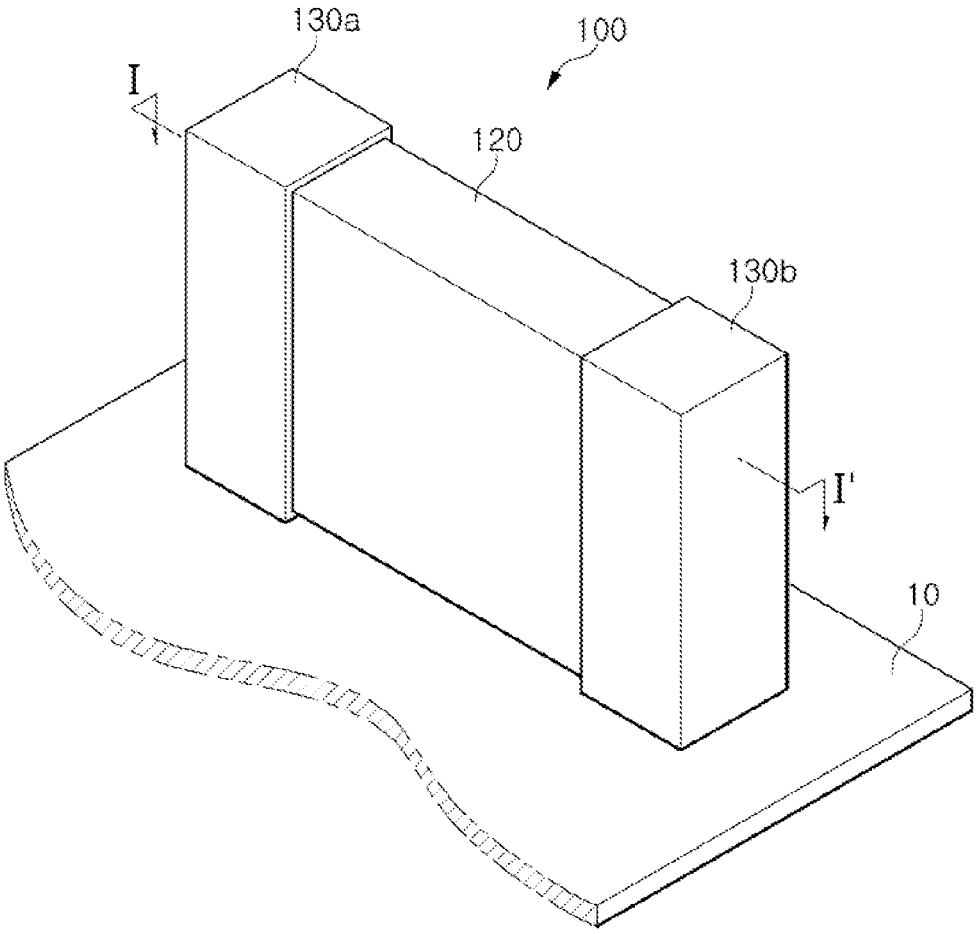
FIG. 1 is a perspective view of a chip antenna, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

A chip antenna described herein may be operated in a high-frequency region. For example, the disclosed antenna is operated in a frequency band from 3 GHz to 30 GHz or less. Further, the chip antenna described herein may be mounted in an electronic device configured to wirelessly receive and/or transmit a signal. For example, the chip antenna may be mounted in a portable phone, a portable notebook computer, a drone, or another electronic device.

Figure 2:
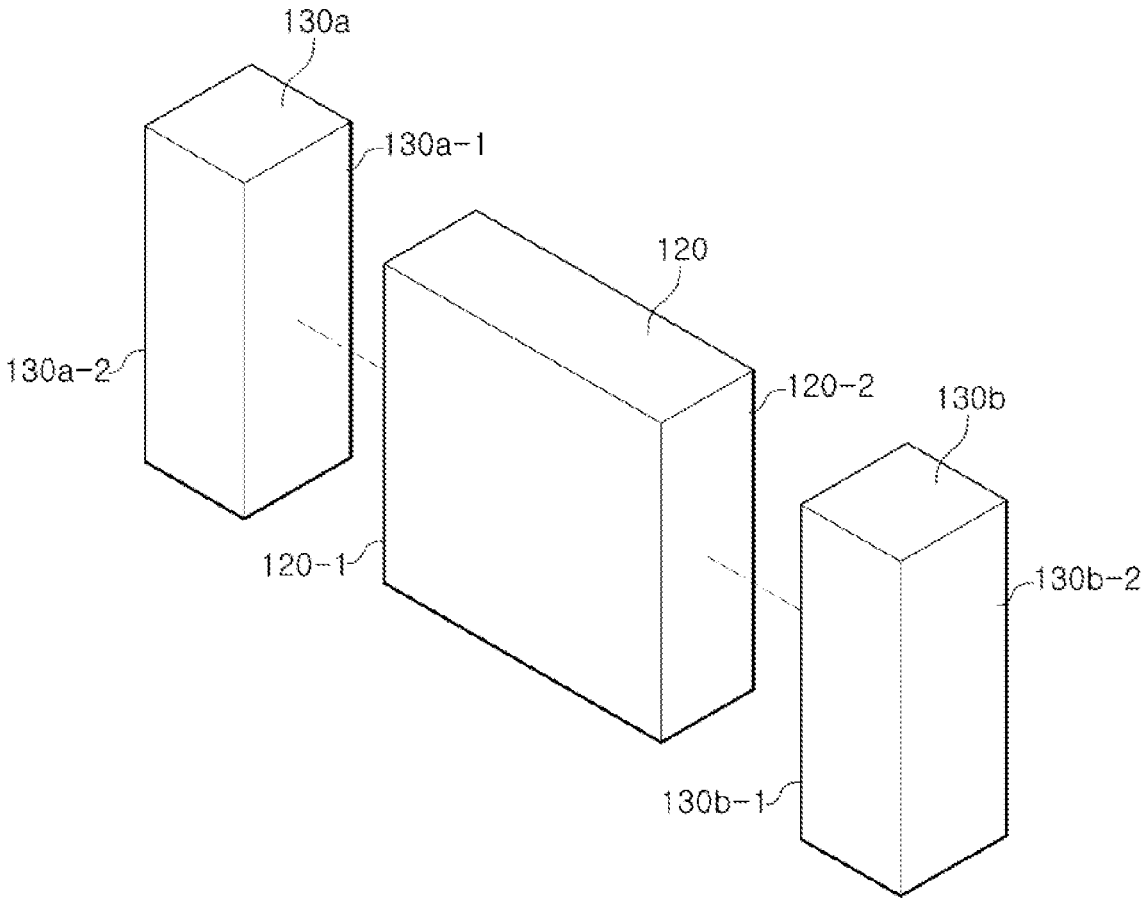
FIG. 2 is an exploded perspective view of the chip antenna illustrated in FIG. 1.
Figure 3:
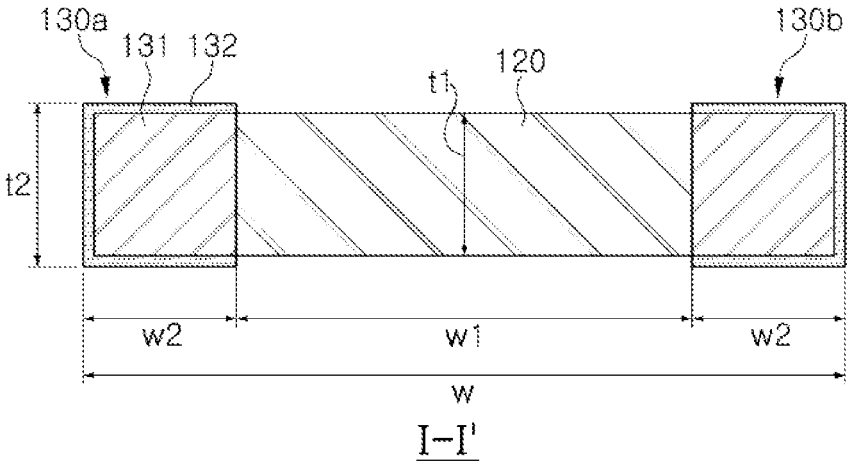
FIG. 3 is a cross-sectional view taken along line I-I' of FIG. 1.
Figure 4:
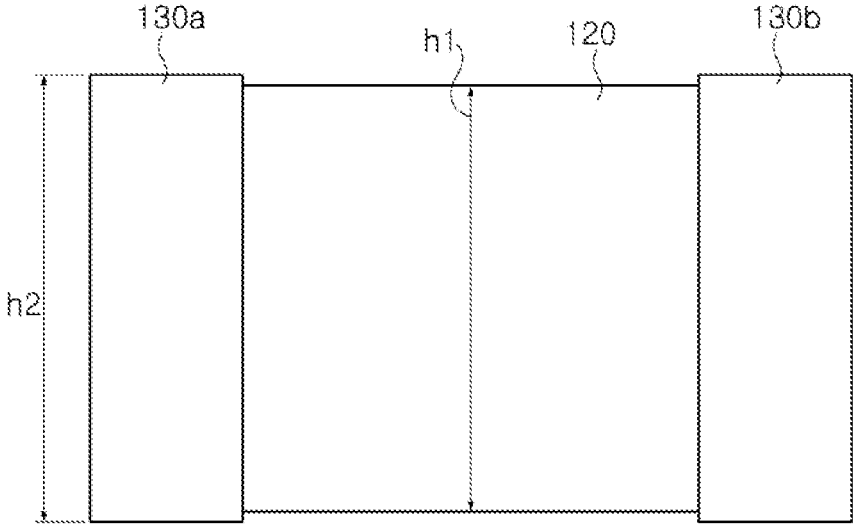
FIG. 4 is a side view of the chip antenna illustrated in FIG. 1.

FIG. 1 is a perspective view of a chip antenna 100, according to an embodiment. FIG. 2 is an exploded perspective view of the chip antenna 100. Further, FIG. 3 is a cross-sectional view taken along line I-I' of FIG. 1. FIG. 4 is a side view of the chip antenna 100.

Referring to FIGS. 1 through 4, the chip antenna 100 has an overall shape of a hexahedron, and may be mounted on a board 10 using a conductive adhesive such as solder.

The board 10 may be a circuit board on which a circuit or an electronic component required for a wireless antenna is mounted. For example, the board 10 is a printed circuit board (PCB) having one or more electronic components accommodated therein or having a surface on which one or more electronic components are mounted. Therefore, the board 10 may include a circuit wiring electrically connecting electronic components to each other.

The chip antenna 100 includes a body portion 120, a radiation portion 130*a*, and a ground portion 130*b*.

The body portion 120 has a hexahedral shape and is formed of a dielectric substance. For example, the body portion 120 is formed of a polymer or sintered ceramic having permittivity.

As described above, the chip antenna 100 may be used in a band of 3 GHz to 30 GHz. Accordingly, corresponding to a wavelength, a length of the longest side (width w in FIG. 3) of the chip antenna is 2 mm or less. For example, a length of the longest side (width w in FIG. 3) may be 0.5 to 2 mm to adjust a resonance frequency in the above-described frequency band.

In a case in which permittivity of the body portion 120 is less than 3.5 farads per meter (f/m), a distance between the radiation portion 130*a* and the ground portion 130*b* needs to be increased in order for the chip antenna 100 to operate normally.

According to a test result, in the case in which the permittivity of the body portion was less than 3.5 f/m, the chip antenna functioned normally in the band of 3 GHz to 30 GHz only when a maximum width w of the chip antenna 100 was 2 mm or more. In this case, however, since an overall size of the chip antenna is increased, it is difficult to mount the chip antenna in a thin portable device.

In addition, in a case in which the permittivity exceeds 25 f/m, the size of the chip antenna needs to be decreased to 0.3 mm or less, and, in this case, performance of the antenna was substantially deteriorated.

Therefore, the body portion 120 of the chip antenna 100, according to an embodiment, is manufactured by using a dielectric having permittivity of 3.5 f/m to 25 f/m.

Referring to FIG. 2, the radiation portion 130*a* is coupled to a first surface 120-1 of the body portion 120. Further, the ground portion 130*b* is coupled to a second surface 120-2 of the body portion 120. In this example, the first surface 120-1 and the second surface 120-2 of the body portion 120 are surfaces facing opposite directions, wherein the body portion 120 has the hexahedral shape.

Referring to FIGS. 2 and 3, a width w1 of the body portion 120 is a distance between the first surface 120-1 of the body portion 120 and the second surface 120-2 of the body portion 120. Therefore, a direction toward the second surface 120-2 from the first surface 120-1 (or a direction toward the first surface 120-1 from the second surface 120-2) is defined as a width direction of the body portion 120 or the chip antenna 100.

Referring to FIGS. 2 and 3, widths w2 of the radiation portion 130*a* and the ground portion 130*b* are distances in the width direction of the chip antenna 100. Therefore, the width w2 of the radiation portion 130*a* is a shortest distance from a first, bonding surface 130*a*-1 of the radiation portion 130*a* bonded to the first surface 120-1 of the body portion 120, to a second surface 130*a*-2 of the radiation portion 130*a* opposite to the first, bonding surface 130*a*-1 of the radiation portion 130*a*. Similarly, the width w2 of the ground portion 130*b* is a shortest distance from a first, bonding surface 130*b*-1 of the ground portion 130*b* bonded to the second surface 120-2 of the body portion 120 to a second surface 130*b*-2 of the ground portion 130*b* opposite to the first, bonding surface 130*b*-1 of the ground portion 130*b*.

The radiation portion 130*a* contacts only one of six surfaces of the body portion 120 and is coupled to the body portion 120. Similarly, the ground portion 130*b* contacts only one of the six surfaces of the body portion 120 and is coupled to the body portion 120.

As such, the radiation portion 130*a* and the ground portion 130*b* are not disposed on other surfaces except for the first and second surfaces 120-1 and 120-2 of the body portion 120, and are disposed in parallel with each other while having the body portion 120 interposed therebetween.

In a conventional chip antenna used in a low-frequency band, a radiation portion and a ground portion are disposed on a lower surface of a body portion. In such a case, since a distance between the radiation portion and the ground portion is short, loss due to inductance occurs. Further, since it is difficult to precisely control the distance between the radiation portion 130*a* and the ground portion 130*b* in a manufacturing process, accurate capacitance may not be predicted and a resonance point may be difficult to adjust, such that tuning of impedance is difficult.

However, in the chip antenna 100, the radiation portion 130*a* and the ground portion 130*b* are have a block form and are coupled to the first and second surfaces 120-1 and 120-2, respectively, of the body portion 120. In the embodiment of FIGS. 1 through 4, the radiation portion 130*a* and the ground portion 130*b* each have a hexahedral shape, and one surface of each of the hexahedrons is bonded to the first and second surfaces 120-1 and 120-2 of the body portion 120, respectively.

In an example in which the radiation portion 130*a* and the ground portion 130*b* are coupled to only the first and second surfaces 120-1 and 120-2 of the body portion 120, since a spacing distance between the radiation portion 130*a* and the ground portion 130*b* is defined by a size of the body portion 120, all the above-described problems in a conventional chip antenna may be solved.

In addition, since the chip antenna 100 has capacitance due to a dielectric (e.g., the body portion 120) being disposed between the radiation portion 130*a* and the ground portion 130*b*, a coupling antenna may be designed or a resonance frequency may be tuned by using this characteristic.

Figure 5:
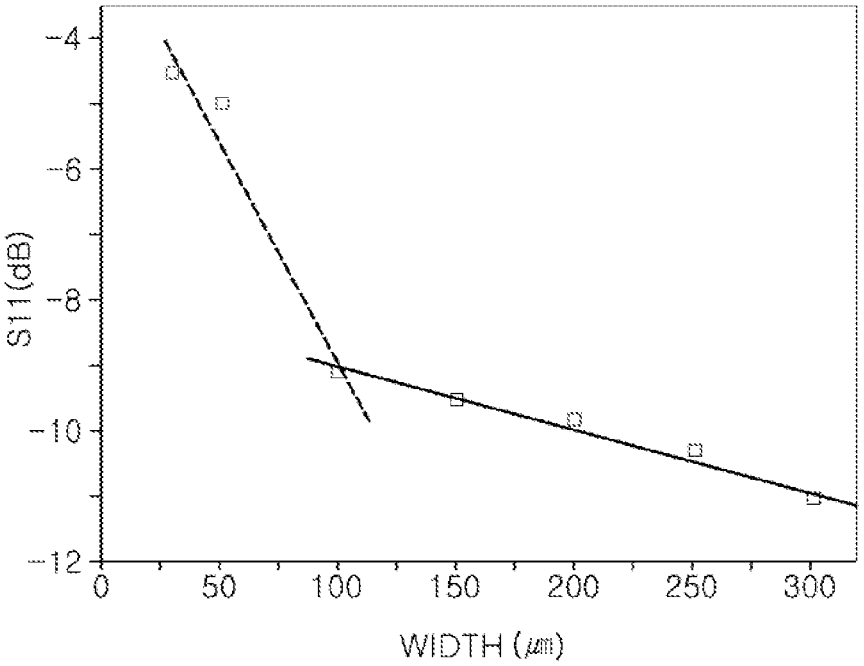
FIG. 5 is a graph showing radiation efficiency of a chip antenna configured as illustrated in FIG. 1.

FIG. 5 is a graph showing radiation efficiency of a chip antenna configured as illustrated in FIG. 1. Reflection loss S11 of the chip antenna was measured while increasing the width w2 of each of the radiation portion 130*a* and the ground portion 130*b* in a band of 28 GHz.

The measurement was performed by fixing a thickness t2 and a height h2 of the radiation portion 130*a* and the ground portion 130*b* of the chip antenna 100 to 0.6 mm and 1.3 mm, respectively, while changing only the width w2.

Referring to FIG. 5, it can be appreciated that the reflection loss S11 of the chip antenna was reduced as the width w2 of each of the radiation portion 130*a* and the ground portion 130*b* was increased. Further, in a section in which the width w2 of each of the radiation portion 130*a* and the ground portion 130*b* was 100 μm or less, the reflection loss S11 was reduced at a high reduction rate as the width w2 was increased, and in a section in which the width w2 exceeded 100 μm, the reflection loss S11 was reduced at a relatively low reduction rate as the width w2 was increased.

Accordingly, the chip antenna 100 may be configured such that the width w2 of each of the radiation portion 130*a* and the ground portion 130*b* is equal to or greater than 100 μm.

However, when the width w2 of each of the radiation portion 130*a* and the ground portion 130*b* is larger than the width w1 of the body portion 120, the radiation portion 130*a* or the ground portion 130*b* may be separated from the body portion 120 when external impact is applied to the chip antenna or when the chip antenna is mounted on the board. Accordingly, the chip antenna 100 may be configured such that a maximum width w2 of the radiation portion 130*a* or the ground portion 130*b* is equal to or less than 50% of the width w1 of the body portion 120.

As described above, since the maximum length (width w) of the chip antenna 100 may be 2 mm, when the radiation portion 130*a* and the ground portion 130*b* are configured to have the same width, a maximum width and a minimum width of the radiation portion 130*a* or the ground portion 130*b* may be 500 μm and 100 μm, respectively. However, the maximum width and the minimum width of the radiation portion 130*a* or the ground portion 130*b* are not limited to these examples, and when the width of the radiation portion 130*a* and the width the ground portion 130*b* are different from each other, the maximum width may be changed.

The radiation portion 130*a* and the ground portion 130*b* may be formed of the same material. Further, the radiation portion 130*a* and the ground portion 130*b* may be formed to have the same shape and the same structure. In this case, the radiation portion 130*a* and the ground portion 130*b* may be classified according to a type of electrode to which the radiation portion 130*a* and the ground portion 130*b* are bonded when being mounted on the board 10. For example, a portion of the chip antenna 100 that is bonded to a feeding electrode of the board 10 may function as the radiation portion 130*a*, and a portion of the chip antenna 100 that is bonded to a ground electrode of the board 10 may function as the ground portion 130*b*. However, the radiation portion 130*a* and the ground portion 130*b* are not limited to the aforementioned bonding configurations.

The radiation portion 130*a* and the ground portion 130*b* each include a first conductor 131 and a second conductor 132.

The first conductor 131 is a conductor directly bonded to the body portion 120 and formed in a block form. The second conductor 132 is formed in a layer form along a surface of the first conductor 131.

The first conductor 131 may be formed on the body portion 120 by printing or plating, and may be formed of any one selected from Ag, Au, Cu, Al, Pt, Ti, Mo, Ni, and W, or an alloy of two or more thereof. In addition, the first conductor 131 may also be formed of a conductive paste in which an organic material such as a polymer or glass is contained in metal or a conductive epoxy.

The second conductor 132 may be formed on the surface of the first conductor 131 by plating. The second conductor 132 may be formed by sequentially stacking a nickel (Ni) layer and a tin (Sn) layer or by sequentially stacking a zinc (Zn) layer and a tin (Sn) layer, but is not limited to these examples.

The first conductor 131 has the same thickness and the same height as a thickness and a height of the body portion 120. Therefore, as illustrated in FIGS. 3 and 4, the radiation portion 130*a* and the ground portion 130*b* are thicker and taller than the body portion 120 due to the second conductor 132 being formed on the surface of the first conductor 131.

The chip antenna 100 configured as described above may be used in a high-frequency band of 3 GHz to 30 GHz, and may have a longest side having a length of 2 mm or less to thereby be easily mounted in a thin portable device.

Further, since the radiation portion 130*a* and the ground portion 130*b* each contact only one surface of the body portion 120, tuning of a resonance frequency is easy, and radiation efficiency of the antenna may be significantly increased through adjustment of a volume of the antenna.

In addition, the width w2 of each of the radiation portion 130*a* and the ground portion 130*b* may be equal to or greater than 100 μm, thereby significantly reducing the reflection loss while significantly decreasing the size of the chip antenna 100.

In the embodiment described above, only a value of the width w2 of each of the radiation portion 130*a* and the ground portion 130*b* is limited, but an example in which the thickness t2 or the height h2 of the radiation portion 130*a* and the ground portion 130*b* is changed may also be considered.

As a result of measuring reflection loss when expanding the height h2 of the radiation portion 130*a* and the ground portion 130*b* to 1.5 mm, the reflection loss S11 was significantly reduced when the width w2 was increased to 100 μm, similar to the results illustrated in FIG. 5, but the resonance frequency moved from 28 GHz to 25 GHz.

Further, as a result of measuring reflection loss by expanding the thickness t2 of the radiation portion 130*a* and the ground portion 130*b* to 1.2 mm, the reflection loss S11 was largely reduced when the width w2 is increased to 100 μm, similar to that illustrated in FIG. 5, but the resonance frequency moved from 28 GHz to 15 GHz.

Accordingly, it can be appreciated that a change in the height h2 or the thickness t2 of the radiation portion 130*a* and the ground portion 130*b* is a factor that determines the resonance frequency, and the width w2 of each of the radiation portion 130*a* and the ground portion 130*b* is a factor determining the reflection loss, in the chip antenna structure according to the embodiment of FIGS. 1 through 4.

Therefore, the chip antenna a100 significantly reduces reflection loss by increasing the size of the radiation portion 130*a* and the ground portion 130*b* in a width direction.

Next, a method of manufacturing the chip antenna 100, according to an embodiment, will be described.

Figure 6:
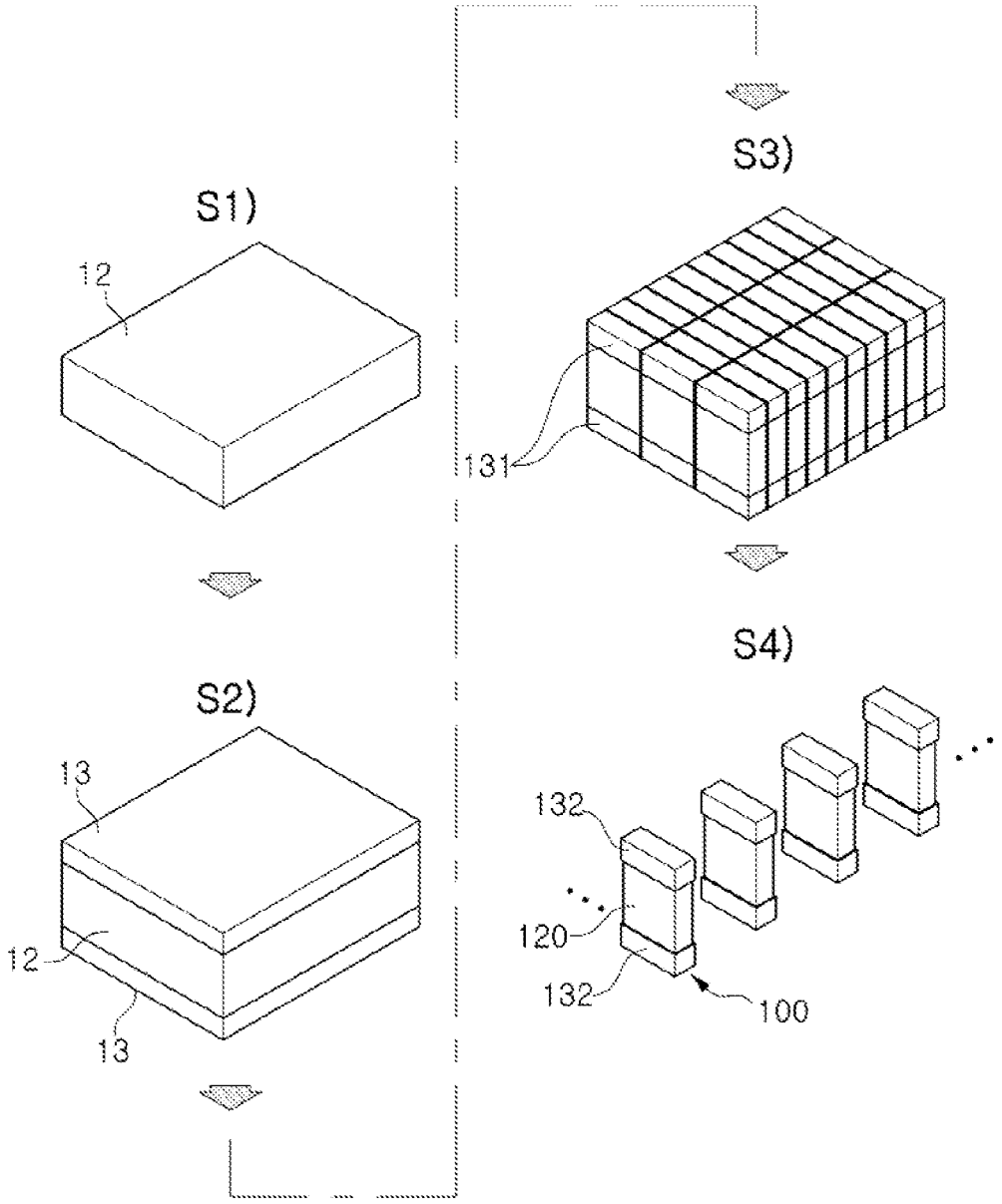
FIG. 6 is a view illustrating a method of manufacturing the chip antenna illustrated in FIG. 1, according to an embodiment.

FIG. 6 is a view for describing an example method of manufacturing the chip antenna 100 of FIG. 1.

Referring to FIG. 6, first, a dielectric member 12 having permittivity of 3.5 to 25 f/m is prepared in operation S1. The dielectric member 12 may be prepared in a flat plate shape by using a polymer or a sintered ceramic. The dielectric member 12 is later formed to be the body portion 120 of the chip antenna 100.

Next, conductor layers 13 are formed on a first surface and the second surface of the dielectric member 12 in operation S2. The conductor layers 13 are formed on the dielectric member 12 by printing or plating, while having a thickness of 100 μm to 500 μm.

In order to form the conductor layer 13 having a thickness of 100 μm or more, applying of a conductive material and drying of the applied conductive material, or plating, may be repeatedly performed in operation S2.

In addition, applying of the conductive material and drying of the applied conducive material may be performed simultaneously on both surfaces of the dielectric member 12, or may be sequentially performed on one of the surfaces of the dielectric member 12 at a time.

The conductor layer 13 may be formed of any one selected from Ag, Au, Cu, Al, Pt, Ti, Mo, Ni, and W, or an alloy of two or more thereof. In addition, the conductor layer 13 may also be formed of a conductive paste in which an organic material such as a polymer or glass is contained in metal or a conductive epoxy (e.g., Ag-epoxy).

The conductor layer 13 is later formed to be the first conductor 131 of the chip antenna 100.

Next, the dielectric member 12 and the conductor layers 13 stacked on both surfaces of the dielectric member 12 are cut into a size of the chip antenna in operation S3. By the cutting of the dielectric member 12 and the conductor layers 13, the dielectric member 12 is formed to be the body portion 120 of the chip antenna 100, and the conductor layers 13 are formed to be the first conductors 131 of the chip antenna 100. In operation S3, the conductor layers 13 are cut together with the dielectric member 12. Therefore, the thickness and the height of the first conductor 131 are the same as those of the body portion 120.

The cutting may be performed using a blade, a saw, laser, or a wire.

Next, the second conductor 132 is formed on the surface of the first conductor 131 in operation S4. The second conductor 132 may be formed by plating, and may be formed of Ni/Sn, Zn/Sn, or another suitable material.

The chip antenna 100 is not limited to the above-described configuration, and may be modified in various ways.

FIGS. 7 through 11 are perspective views illustrating chip antennas according to other embodiments. In each of the chip antennas illustrated in FIGS. 7 through 10, the radiation portion has a volume larger than that of the ground portion. The chip antennas of FIGS. 7 through 11 are similar to the chip antenna 100 of FIGS. 1 through 4, with the exception of the configuration of respective radiation portions. Accordingly, the following discussion of FIGS. 7 through 11 focuses primarily on differences with respect to the chip antenna 100 of FIGS. 1 through 4.

Figure 7:
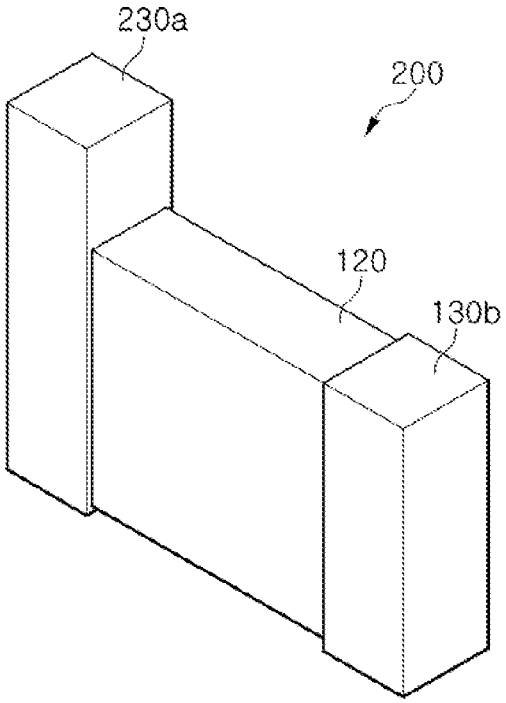
FIGS. 7 through 10 are perspective views illustrating chip antennas, according to other embodiments.

First, in the chip antenna 200 illustrated in FIG. 7, a height of a radiation portion 230*a* is greater than that of the body portion 120 or the ground portion 130*b*. Accordingly, a portion of the radiation portion 130*a* protrudes from an upper portion of the chip antenna.

Figure 8:
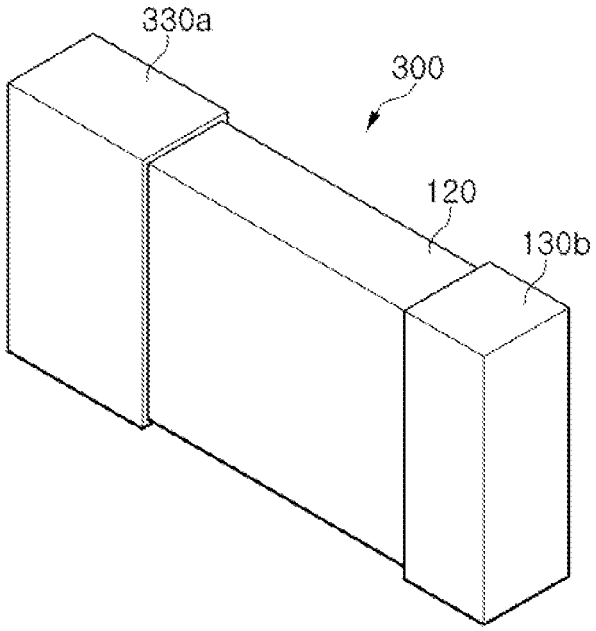

In the chip antenna 300 illustrated in FIG. 8, a width of a radiation portion 330*a* is greater than that of the ground portion 130*b*. FIG. 8 illustrates an example in which the width of the radiation portion 330*a* is about two times greater than that of the ground portion 130*b*, but the width of the radiation portion 330*a* is not limited to this example. For example, the width of the radiation portion 330*a* may be greater than that of the ground portion 130*b* by 50 μm or more.

Figure 9:
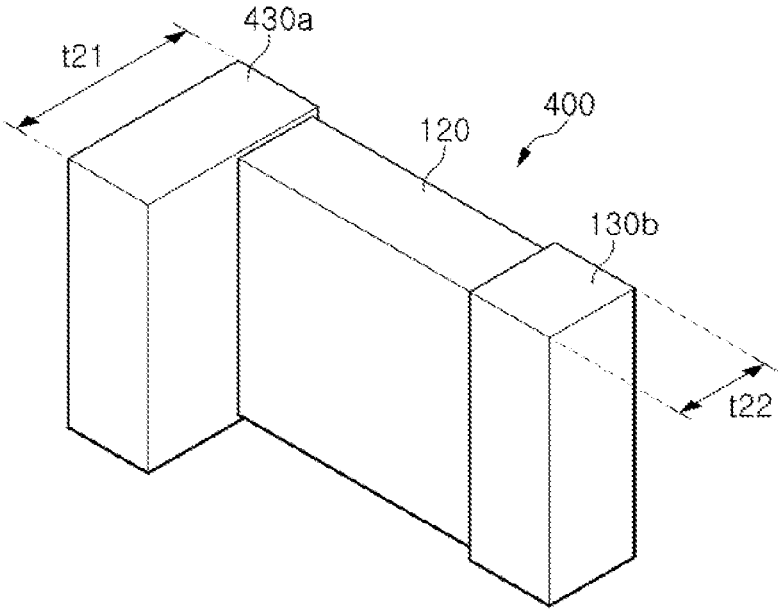

In the chip antenna 400 illustrated in FIG. 9, a thickness t21 of a radiation portion 430*a* is greater than a thickness t22 of the ground portion 130*b*. Accordingly, a portion of the radiation portion 430*a* protrudes from a front surface or a rear surface of the chip antenna 400.

Figure 10:
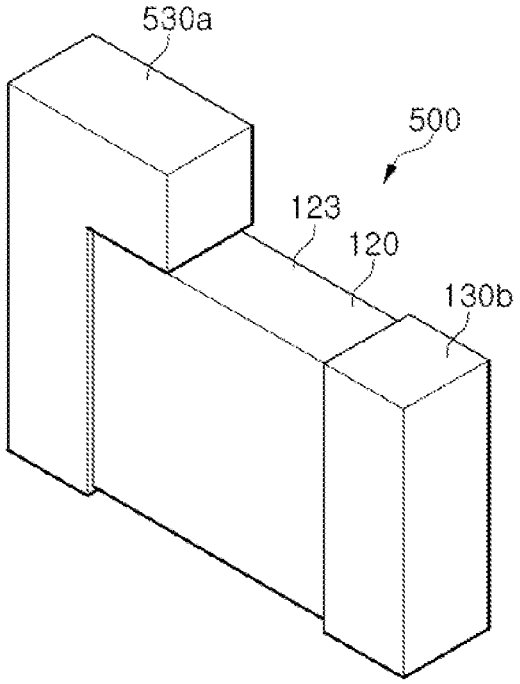

In the chip antenna 500 illustrated in FIG. 10, a protruding portion of a radiation portion 530*a* protrudes onto an upper portion of the body portion 120. Further, the protruding portion of the radiation portion 530*a* is extended on the upper portion of the body portion 120, toward the ground portion 130*b*. Accordingly, a portion of the radiation portion 530*a* extends onto a third surface 123 of the body portion 120 that extends between the first surface 121 and the second surface 122 of the body portion.

The chip antennas 200, 300, 400, and 500 disclosed in FIGS. 7 through 10 may be manufactured in a similar manner to the manufacturing method of the chip antenna 100 described above with respect to FIG. 6, and after performing operation S2 and before performing the cutting in operation S3 or the plating in operation S4, additional formation of a protruding portion on the first conductor 131 may be performed. The formation of the protruding portion may be performed by printing or plating, but is not limited to these methods, and various methods, such as a method of separately manufacturing a corresponding portion in a block form and then bonding the portion on the first conductor, may be used.

Figure 11:
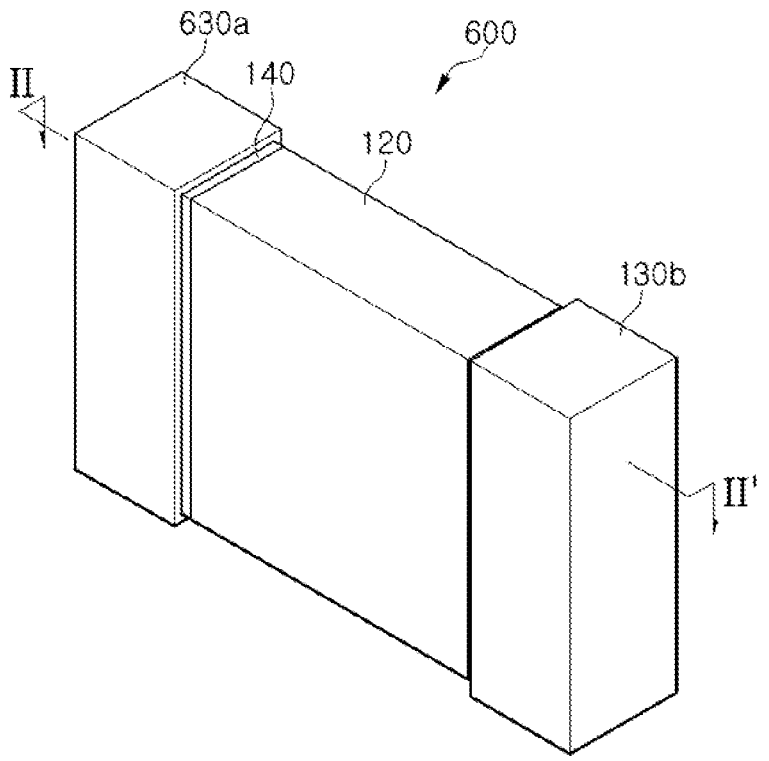
FIG. 11 is a perspective view illustrating a chip antenna, according to another embodiment.
Figure 12:
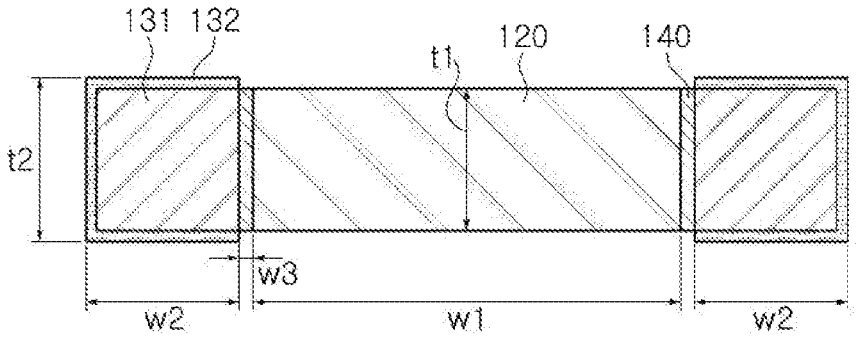
FIG. 12 is a cross-sectional view taken along line II-II' of FIG. 11.

FIG. 11 is a perspective view illustrating a chip antenna 600, according to another embodiment, and FIG. 12 is a cross-sectional view taken along line II-I' of FIG. 11.

Referring to FIGS. 11 and 12, in the chip antenna 2600, bonding portions 140 are disposed between the body portion 120 and the radiation portion 130*a*, and between the body portion 120 and the ground portion 130*b*, respectively.

The bonding portion 140 bonds the first conductor 131 and the body portion 120 to each other. Accordingly, the radiation portion 130*a* and the ground portion 130*b* are bonded to the body portion 120 through the bonding portion 140.

The bonding portion 140 is provided to firmly couple the radiation portion 130*a* and the ground portion 130*b* to the body portion 120.

Accordingly, the bonding portion 140 may be formed of a material that may be easily bonded to the radiation portion 130*a*, the ground portion 130*b*, and the body portion 120.

For example, the bonding portion 140 is formed of any one or any combination of any two or more of Cu, Ti, Pt, Mo, W, Fe, Ag, Au, and Cr. Further, the bonding portion 140 may be formed by using a Ag-paste, a Cu-paste, a Ag—Cu paste, a Ni-Paste, or a solder paste.

Further, the bonding portion 140 may be formed of a material such as an organic compound, glass, $SiO_2$, graphene, or graphene oxide.

In an example, the bonding portion 140 is formed to have a width w3 of 10 to 50 μm. However, the width of the bonding portion 140 is not limited to such an example, and the bonding portion 140 may have various widths in a range of less than the width w2 of the radiation portion 130*a* or the ground portion 130*b*.

FIGS. 11 and 12 illustrate an example in which the bonding portion 140 is formed in a single layer. However, various modifications may be made to the bonding portion 140. For example, the bonding portion 140 may be formed by stacking a plurality of layers.

In addition, an example in which the second conductor 132 is not formed on a surface of the bonding portion 140 is illustrated in FIGS. 11 and 12 for ease of understanding. However, the bonding portion 140 is not limited to such a configuration, and the second conductor 132 may also be formed on the surface of the bonding portion 140. In this case, since the second conductor 132 is disposed on an entire surface of the first conductor 131 and the bonding portion 140, the chip antenna is formed in the shape illustrated in FIG. 1, and presence or absence of the bonding portion 140 is difficult to visually confirm with naked eyes.

Figure 13:
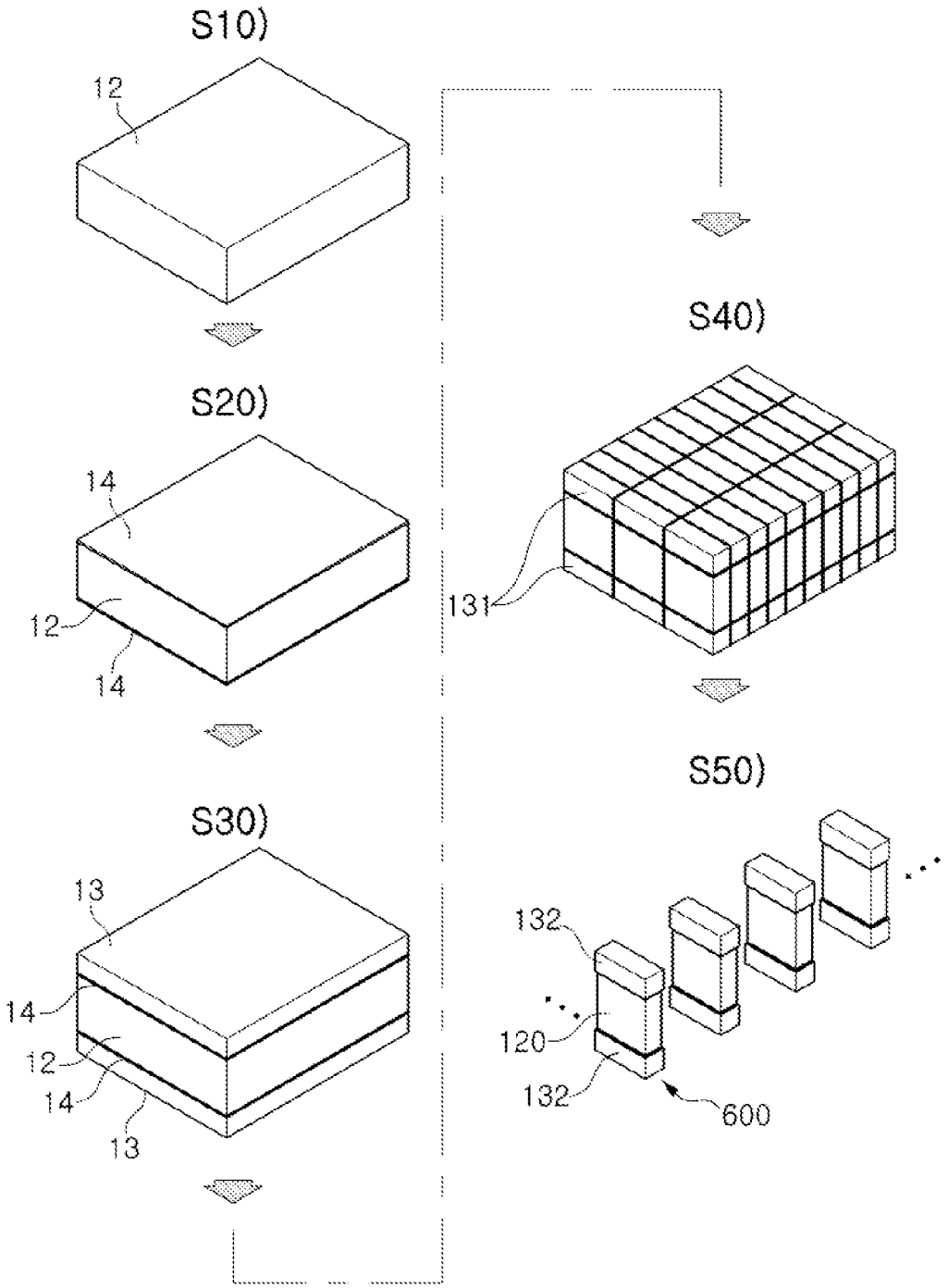
FIG. 13 is a view illustrating a method of manufacturing the chip antenna illustrated in FIG. 11, according to an embodiment.

FIG. 13 is a view illustrating a method of manufacturing the chip antenna 600.

Referring to FIG. 13, in the manufacturing method of the chip antenna 600, the dielectric member 12 is prepared in operation S10, and then bonding layers 14 are formed on two opposite surfaces of the dielectric member 12 in operation S20.

The bonding layers 14 may be formed by applying a bonding material on the two opposite surfaces of the dielectric member 12 by any one of printing, sputtering, spraying, and deposition, while having a thickness of 10 to 50 μm.

Any one or any combination of any two or more of Cu, Ti, Pt, Mo, W, Fe, Ag, Au, and Cr may be used as the bonding material. Further, a Ag-paste, a Cu-paste, a Ag—Cu paste, a Ni-Paste, or a solder paste may be used, or a material such as an organic compound, glass, $SiO_2$, graphene, or graphene oxide may be used.

The bonding layer 14 is later formed to be the bonding portion 140 of the chip antenna 600.

Next, the conductor layers 13 are formed on the bonding layers 14 in operation S30, and the dielectric member 12, the conductor layers 13, and the bonding layers 14 are cut in operation S40 to form the body portion 120 and the first conductors 131. Then, the second conductor 132 is formed on surfaces of the first conductors 131 in operation S50, thereby completing the chip antenna 600.

The cutting in operation S40 and the forming of the second conductor 132 in operation S50 are performed in the same manner as in steps S3 and S4 in FIG. 6 described above, and thus the detailed description therefor will be omitted.

As set forth above, a chip antenna according to an embodiment may be used in a high-frequency band of 3 GHz to 30 GHz, and may be formed in a small size to be easily mounted in a thin portable electronic device.

Further, since the radiation portion and the electrode portion of the chip antenna each contact only one surface of the body portion of the chip antenna, tuning of a resonance frequency is easy, and radiation efficiency of the antenna may be significantly increased through adjustment of a volume of the antenna.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna, comprising:

a hexahedral-shaped body portion having a permittivity, and comprising a first surface and a second surface opposite to the first surface;

a radiation portion coupled to the first surface of the body portion and having; and a ground portion coupled to the second surface of the body portion, wherein respective surfaces of the radiation portion and the ground portion are bonded to a substrate.

2. The chip antenna of claim 1, wherein the body portion comprises a dielectric having a permittivity of 3.5 f/m or to 25 f/m.

3. The chip antenna of claim 1, wherein the radiation portion and the ground portion each comprise a first conductor bonded to the body portion and a second conductor disposed on a surface of the first conductor.

4. The chip antenna of claim 3, further comprising a bonding portion disposed between the first conductor and the body portion, and bonding the first conductor and the body portion to each other.

5. The chip antenna of claim 3, wherein a height of each of the radiation portion and the ground portion is greater than a height of the body portion.

6. The chip antenna of claim 3, wherein a thickness of each of the radiation portion and the ground portion is greater than a thickness of the body portion.

7. The chip antenna of claim 1, wherein the width of the radiation portion and the width of the ground portion are the same.

8. The chip antenna of claim 1, wherein the width of the radiation portion is greater than the width of the ground portion.

9. The chip antenna of claim 1, wherein a thickness of the radiation portion is different from a thickness of the ground portion, or a height of the radiation portion is different from a height of the ground portion.

10. The chip antenna of claim 1, wherein the chip antenna is hexahedral-shaped and comprises a longest side having a length of 2 mm or less.

11. The chip antenna of claim 1, wherein the chip antenna is configured to operate in a frequency band of 3 GHz to 30 GHz.

12. The chip antenna of claim 1, wherein the radiation portion comprises a protruding portion protruding onto a third surface of the body portion and extending toward the ground portion.

13. The chip antenna of claim 1, wherein a width of each of the radiation portion and the ground portion is in a range of 100 μm to 500 μm.

14. A method to manufacture a chip antenna, the manufacturing method comprising:

disposing conductor layers on two surfaces of a dielectric member by printing or plating;

cutting the dielectric member, with the conductor layers disposed thereon, into chip antenna;

disposing a conductor on surfaces of each of the conductor layers; and bonding respective surfaces of the conductor layers to a substrate.

15. The manufacturing method of claim 14, wherein the forming of the conductor layers comprises forming the conductor layers on the two surfaces of the dielectric member such that the conductor layers comprise a thickness of 100 μm to 500 μm.

16. The manufacturing method of claim 14, wherein the conductor is formed of either one of Ni/Sn and Zn/Sn by plating.

17. The manufacturing method of claim 14, further comprising, before the forming of the conductor layers, forming bonding layers on the two surfaces of the dielectric member.

18. The manufacturing method of claim 17, wherein the bonding layers are formed by any one of printing, sputtering, spraying, and deposition, and each of the bonding layers comprise a thickness of 10 μm to 50 μm.

* * * * *